US007455047B2

(12) United States Patent
Hashizume et al.

(10) Patent No.: US 7,455,047 B2
(45) Date of Patent: Nov. 25, 2008

(54) CONTROL UNIT FOR AN INTERNAL COMBUSTION ENGINE

(75) Inventors: Mitsuo Hashizume, Saitama (JP); Kentaro Onuma, Saitama (JP); Takahide Mizuno, Saitama (JP); Shusuke Akazaki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/790,078

(22) Filed: Apr. 23, 2007

(65) Prior Publication Data

US 2007/0251494 A1 Nov. 1, 2007

(30) Foreign Application Priority Data

Apr. 25, 2006 (JP) ..... 2006-121075

(51) Int. Cl.
*F02D 41/00* (2006.01)

(52) U.S. Cl. ..... 123/435

(58) Field of Classification Search ..... 123/435, 123/406.22, 406.42

See application file for complete search history.

(56) References Cited

U.S. PATENT DOCUMENTS

| | | | | |
|---|---|---|---|---|
| 4,466,408 | A * | 8/1984 | Cheklich | 123/406.43 |
| 4,556,030 | A * | 12/1985 | Aono | 123/406.42 |
| 7,000,596 | B2 * | 2/2006 | Zurloye et al. | 123/435 |
| 2005/0229903 | A1 * | 10/2005 | Kobayashi et al. | 123/435 |

FOREIGN PATENT DOCUMENTS

JP 63-078036 4/1988

* cited by examiner

*Primary Examiner*—Erick Solis
(74) *Attorney, Agent, or Firm*—Arent Fox LLP

(57) ABSTRACT

An engine control unit includes pressure detector provided in a combustion chamber of the engine. A motoring pressure of the engine is estimated. A combustion starting time is detected when the difference between an internal pressure detected by the pressure detector and the pressure estimated by the ECU exceeds a predetermined value. When the internal pressure detected by the pressure detector reaches its peak after the combustion starting time has been detected, the crank angle at this time point is determined to correspond to the maximum internal cylinder pressure that is generated by combustion.

8 Claims, 8 Drawing Sheets

CONTROL UNIT FOR AN INTERNAL COMBUSTION ENGINE

BACKGROUND OF THE INVENTION

The present invention relates to a technique for detecting a crank angle corresponding to a maximum internal cylinder pressure for each cylinder having an pressure sensor.

In order to carry out a feedback control of ignition timing toward a predetermined desired crank angle, an internal cylinder pressure sensor is provided in each cylinder for detecting a maximum internal cylinder pressure so as to determine a crank angle when the maximum pressure is detected. In this technique, when a control for suppressing an engine output is performed, for example, when ignition timing is retarded for a rapid warming-up of catalyst after the engine starts, the ignition is made around the top dead center (TDC) or after the top dead center and the pressure generated by combustion is relatively low. As a result, it is possible that a pressure at the top dead center of a piston is determined to be the maximum pressure.

Japan Patent Application Publication No. S63-78036 proposes a technique for avoiding a wrong detection of a pressure at a top dead center as the maximum pressure during an ignition timing retard operation. This publication discloses an engine combustion detecting apparatus for detecting an engine combustion pressure so as to determine a combustion state based on the maximum value of the detected combustion pressures. Specifically, the disclosed apparatus includes a combustion detecting unit for determining the combustion state by presuming the pressure at a predetermined crank angle after the top dead center of a piston to be the maximum pressure when the maximum pressure sensed during a combustion cycle in a cylinder is equal to the pressure at the top dead center.

The above-referenced technique is intended to determine the combustion state by presuming the pressure at a predetermined crank angle after the top dead center of a piston to be the maximum pressure when the maximum pressure sensed during a combustion cycle in a cylinder is equal to the pressure at the top dead center. However, that approach does not detect a crank angle (θPmax) corresponding to a maximum combustion pressure based on an actual combustion pressure waveform.

As for a multi-cylinder engine, in order to control combustion in each cylinder, it is required to detect a θPmax in each cylinder. It is an objective of the present invention to meet such a requirement.

SUMMARY OF THE INVENTION

A control unit for an engine in accordance with the present invention includes a pressure sensor provided in a combustion chamber of the engine, means for estimating a motoring pressure of the engine and means for detecting, as a combustion start time, a time point when a difference between an internal cylinder pressure that is sensed with the sensor and the pressure that is estimated by the estimation means exceeds a predetermined value. By this control unit, when the pressure detected with the pressure sensor reaches a maximum value after a combustion starting point has been detected by the detecting means, a crank angle at this time point is determined to be a crank angle corresponding to the maximum pressure that is generated by combustion.

According to the invention, a correct detection of θPmax can be made even during an ignition timing retard operation for a purpose of a rapid warming-up after an engine start.

A control unit in accordance with another aspect of the present invention includes a pressure sensor provided in a combustion chamber of the engine, means for estimating a motoring pressure of the engine and means for calculating the difference between an internal cylinder pressure that is calculated based on an output of the pressure sensor at a top dead center of the cylinder of the engine and the pressure that is estimated by the estimation means. When the difference is equal to or smaller than a predetermined value, the control unit determines that the crank angle at a time point when the difference is largest is the crank angle corresponding to the maximum internal cylinder pressure that is generated by combustion.

According to this invention, a correct detection of θPmax can be made even during an ignition timing retard operation for a rapid warming-up of the catalyst after the engine starts.

DESCRIPTION OF THE PREFERRED EMBODIMENTS

Figure 1:
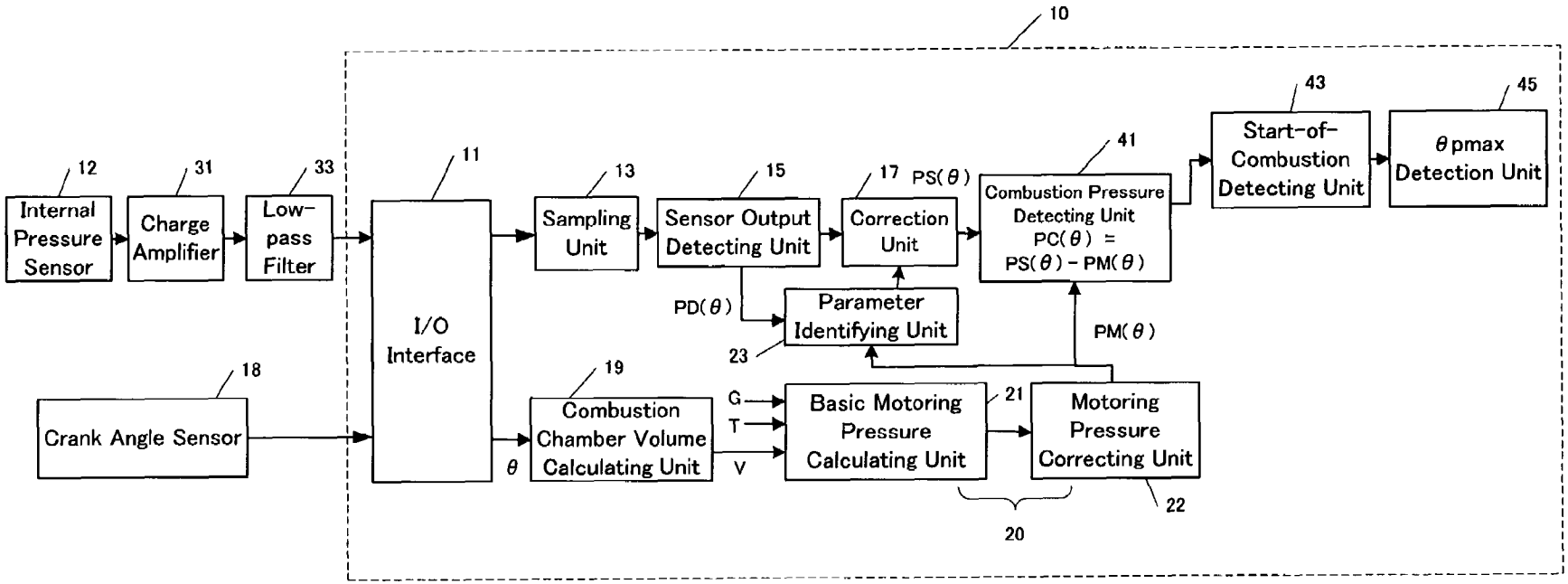
FIG. 1 illustrates functional blocks of a first embodiment of the present invention.

Preferred embodiments of the present invention will be described below with reference to the accompanying drawings. FIG. 1 is a block diagram of an overall structure of a control unit in accordance with the present invention. An electronic control unit (ECU) 10 is a computer having a central processing unit (CPU). ECU 10 includes a Read-Only Memory (ROM) for storing computer programs and data. It also includes a Random Access Memory (RAM) for providing a working space to the processor and temporarily storing data and programs. The ECU includes an input/output interface 11 for receiving detection signals from various parts of an engine and performing A/D (analog to digital) conversion on each signal to pass it to the next stage. The input/output interface 11 sends control signals based on results of CPU operation to various parts of the engine. In FIG. 1, ECU 10 is illustrated in terms of functional blocks representing functions relating to the present invention.

Figure 2:
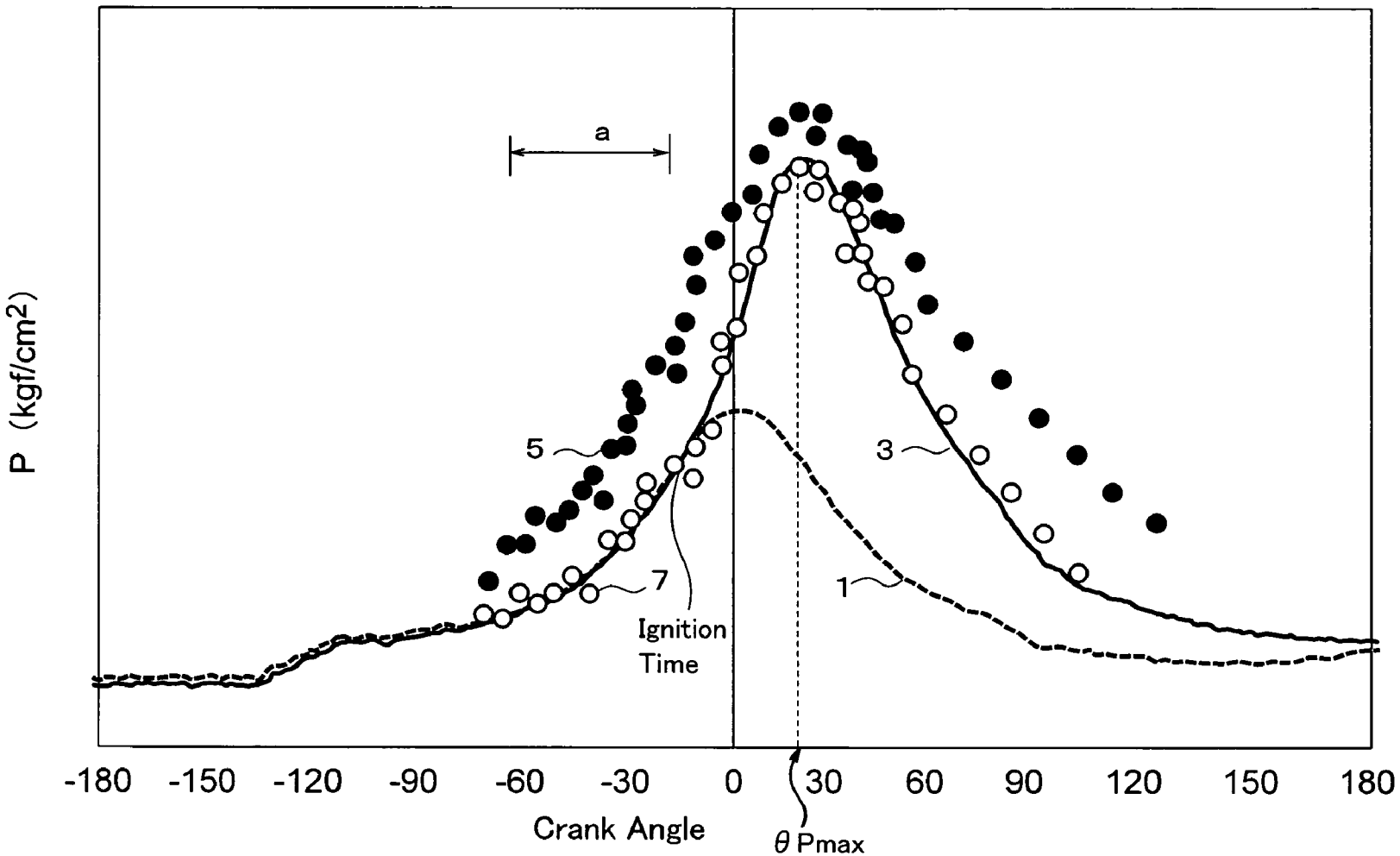
FIG. 2 is a graph showing a motoring pressure curve and a post-ignition pressure curve.

Referring to FIG. 2, a principle of a crank angle detection with the present invention will be first described. FIG. 2 shows pressures in the combustion chamber of a cylinder in the range of −180 degrees to 180 degrees of crank angle during a normal operation. The range of about −180 degrees to 0 degree of crank angle is a compression stroke and the range of about 0 degree to 180 degrees of crank angle is an expansion (combustion) stroke. Curve 1 shows a movement of a motoring pressure (pressure in the absence of combustion) of one cylinder of an engine. Curve 3 shows a movement of an internal cylinder pressure during normal combustion in the same cylinder. The crank angle of 0 degree is the top dead center (TDC). The motoring pressure reaches a peak at the top dead center. The internal pressure during the combustion (Curve 3) reaches the peak slightly after the top dead center when ignition has been made before the top dead center. In this way, in a normal operation, ignition is made slightly before the top dead center in order to raise the peak of the pressure as high as possible.

First, parameters in a correction equation for correcting a detection output from the pressure sensor 12 (FIG. 1) are identified in a period before the top dead center in the compression stroke, for example, in a period "a" as shown in FIG. 2. Black dots 5 represent detection outputs from the pressure sensor 12. The characteristic of the pressure sensor 12 may change due to influence of the temperature, aging deterioration or the like because the sensor is disposed in a very severe environment, that is, in a combustion chamber of an engine. Accordingly, the detection output of the pressure sensor 12 is corrected such that it will be on Curve 1 of the motoring pressure. Such corrected detection outputs are represented by white dots 7.

The correction of the detection output is performed by applying a correction equation $PS=PD(\theta)k_1+C_1$ to the detection output $PD(\theta)$ of the internal pressure sensor. $k_1$ is a correction coefficient and $C_1$ is a constant. These two parameters $k_1$ and $C_1$ of this correction equation are calculated through the method of least squares to minimize a square of a difference (PM−PS) between an estimated motoring pressure value PM and a value PS obtained by correcting a detection value of the internal pressure sensor according to the above-described correction equation in a certain period, for example, in an interval shown by "a" in FIG. 2, during a compression stroke.

Referring back to FIG. 1, the pressure sensor 12, a piezoelectric element, is disposed near a spark plug of each cylinder of the engine. The pressure sensor 12 produces an electric charge signal corresponding to the pressure inside the cylinder. This signal is converted to a voltage signal by a charge amplifier 31 and sent to the input/output interface 11 via a low-pass filter 33. The input/output interface 11 passes the signal from the pressure sensor 12 to a sampling unit 13. The sampling unit 13 performs a sampling in a predetermined interval, for example, in an interval of 1/10 kHz and passes the sample value to a sensor output detecting unit 15.

A sensor output correcting unit 17 corrects the sensor output $PD(\theta)$ in accordance with the above-described correction equation $PS=PD(\theta)k_1+C_1$. The sensor output correcting unit 17 provides the corrected sensor output value PS to a combustion pressure detecting unit 41.

On the other hand, a combustion chamber volume calculating unit 19 calculates a volume $V_c$ of the combustion chamber of the cylinder corresponding to the crank angle θ in accordance with Equation (1) and Equation (2).

$$m=r\{(1-\cos\theta)+\lambda-\sqrt{\lambda^2-\sin^2\theta}\} \quad (1)$$

$$V_c=V_{dead}+A_{pstn}\times m \quad (2)$$

Figure 3:
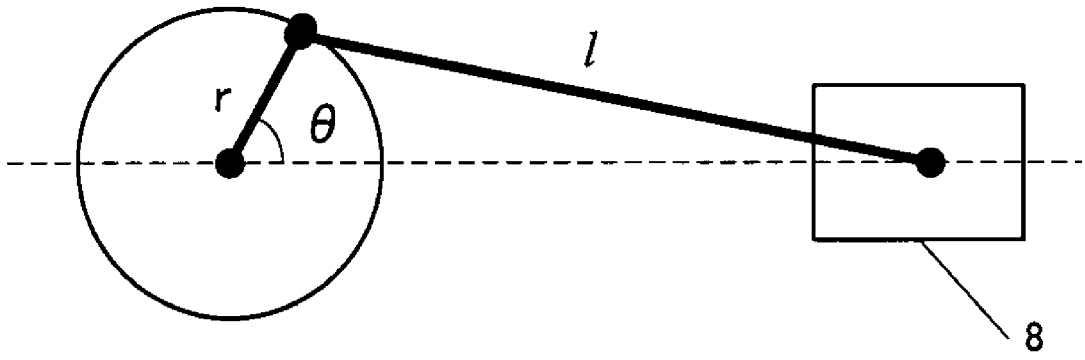
FIG. 3 is a block diagram illustrating conceptually how to calculate a piston position.

In Equation (1) and Equation (2), "m" indicates a displacement of a piston 8 from the top dead center. The displacement is calculated from a relation shown in FIG. 3. Assuming that "r" is the radius of the crank and "l" is length of a connecting rod, $\lambda=1/r$. "$V_{dead}$" represents a combustion chamber volume when the piston is located at the top dead center and "$A_{pstn}$" represents a cross-sectional area of the piston.

It is known that the state equation for a combustion chamber is generally expressed as in Equation (3).

$$PM=\left(\frac{GRT}{V_c}\right)\times k+C \quad (3)$$

"G" is an intake air amount obtained, for example, from an air flow meter, or calculated based on an engine rotational speed and an intake air pressure. "R" is a gas constant, "T" is an intake air temperature obtained, for example, from an intake air temperature sensor, or calculated based on operating conditions of the engine such as an engine water temperature etc. "k" is a correction coefficient and C is a constant.

In the present invention, in order to estimate a value of the motoring pressure based on the equation of gas state for the combustion chamber, the pressure of the combustion chamber is actually measured in advance by using, for example, a crystal piezoelectric type of pressure sensor that is not influenced by temperature change or the like at the place where the sensor is attached. The measured actual pressure value is applied to Equation (3), and k and C for the measured actual pressure are determined, which are respectively represented by $k_0$ and $C_0$. Then, the motoring pressure is estimated by using Equation (4) that is obtained by applying $k_0$ and $C_0$ to Equation (3).

$$PM=\left(\frac{GRT}{V_c}\right)\times k_0+C_0 \quad (4)$$

A motoring pressure estimating unit 20 includes a basic motoring pressure calculating unit 21 and a motoring pressure correcting unit 22. The motoring pressure calculating unit 21 calculates a basic motoring pressure GRT/V that is a basic term of Equation (3). The motoring pressure correcting unit 22 corrects the basic motoring pressure using the parameters $k_0$ and $C_0$ which are obtained in advance as described above. The parameters $k_0$ and $C_0$ are prepared in advance as a map that can be searched based on parameters such as engine rotational speed and absolute air intake pipe pressure, which are indicative of load conditions of the engine.

Alternatively, the motoring pressure estimating unit 20 may be formed by only the basic motoring pressure calculating unit 21. In this case, the basic motoring pressure GRT/V calculated by the basic motoring pressure calculating unit 21 is used as the motoring pressure PM.

A parameter identifying unit 23 uses least squares method to minimize difference (PM−PS) between an estimated motoring pressure value PM calculated during a compression stroke by the motoring pressure estimating unit 20 and an internal pressure PS that is obtained by the sensor output correcting unit 17 based on the output of the pressure sensor 12, and identifies parameters $k_1$ and $C_1$ of an correction equation for correcting sensor outputs. The sensor output detecting unit 15 samples the output of the pressure sensor in a period of 1/10 kHz for example. The sensor output detecting unit 15 provides an average of the sample values as a sensor output value $PD(\theta)$ to the parameter identifying unit 23 in a timing that is synchronized with the crank angle. The parameter identifying unit 23 performs an identification operation in order to identify parameters of the correction equation during a compression stroke of a cylinder. The identification operation obtains $k_1$ and $C_1$ through the known method of least squares to minimize $(PM(\theta)-PD(\theta)k_1-C_1)^2$, that is, a square of the difference between an estimated motoring pressure value PM(θ) obtained by the motoring pressure correcting unit in accordance with the crank angle and value PS obtained by applying the correction equation $PS=PD(\theta)k_1+C_1$ to the sensor output value PD(θ) in the same crank angle.

By expressing discrete values of the PM with y(i) and sample values (discrete values) of the internal cylinder pressure PD obtained from the internal pressure sensor with x(i), following expressions are obtained:

$$P'^T=[p'(0), p'(1), \ldots, p'(n)],\ P^T=[p(\mathbf{0}), p(\mathbf{1}), \ldots, p(n)],\ X(i)^T=[x(\mathbf{0}), x(\mathbf{1}), \ldots, x(n)].$$

The sum of square of the discrete values of the error (P'−P) is expressed as in Equation (5). It is assumed that the sample value is taken in an interval of 1/10 kHz and the value of "i" is limited up to, for example, 100.

$$\begin{aligned} F &= \sum [(kx(i)+C)-y(i)]^2 \\ &= \sum [y(i)-(kx(i)+C)]^2 \\ &= \sum [y(i)^2-2y(i)\times(kx(i)+C)+(kx(i)+C)^2] \end{aligned} \tag{5}$$

k and C for minimizing the value of F are obtained as the values of k and C for which partial differential with respect to k and C respectively of F(k, C) is zero. These values are obtained through Equation (6) and Equation (7).

$$\partial F/\partial k=\Sigma[-2y(i)x(i)+2kx(i)^2+2Cx(i)]=0 \tag{6}$$

$$\partial F/\partial C=\Sigma[-2y(i)+2C+2kx(i)]=0 \tag{7}$$

The right sides of the equations can be arranged as shown in Equation (6)' and Equation (7)'.

$$\Sigma y(i)x(i)=k\Sigma x(i)^2+C\Sigma x(i) \tag{6'}$$

$$\Sigma y(i)=k\Sigma x(i)+C\times n \tag{7'}$$

Matrix expression of these equations is shown in equation (8).

$$\begin{bmatrix} \sum y(i)x(i) \\ \sum y(i) \end{bmatrix} = \begin{bmatrix} \sum x(i)^2 & \sum x(i) \\ \sum x(i) & n \end{bmatrix} \begin{bmatrix} k \\ C \end{bmatrix} \tag{8}$$

Furthermore, Equation (8) can be transformed into Equation (9) by using an inverse matrix.

$$\begin{bmatrix} k \\ C \end{bmatrix} = \begin{bmatrix} \sum x(i)^2 & \sum x(i) \\ \sum x(i) & n \end{bmatrix}^{-1} \begin{bmatrix} \sum y(i)x(i) \\ \sum y(i) \end{bmatrix} \tag{9}$$

The inverse matrix in the right side is Equation (10).

$$\begin{bmatrix} \sum x(i)^2 & \sum x(i) \\ \sum x(i) & n \end{bmatrix}^{-1} = \frac{1}{DET} \begin{bmatrix} n & -\sum x(i) \\ -\sum x(i) & \sum x(i)^2 \end{bmatrix} \tag{10}$$

$$DET = \sum x(i)^2 \times n - \sum x(i) \times \sum x(i)$$

(where, $DET \neq 0$)

The sensor output correcting unit 17 corrects the sensor output PD(θ) by using the parameters thus identified. The corrected sensor output PS(θ) for every predetermined crank angle is passed to the combustion pressure detecting unit 41.

The combustion pressure detecting unit 41 calculates a pressure PC(θ) that is generated purely by combustion when the air-fuel mixture burns in the cylinder of the engine. Referring to FIG. 2, the pressure PS(θ) (Curve 3) detected by the pressure sensor 12 is the sum of the pressure PC(θ) generated by the combustion and the motoring pressure PM(θ) that is a cylinder pressure without combustion. Therefore, PC(θ) is expressed with an equation PC(θ)=PS(θ)−PM(θ).

Figure 4:
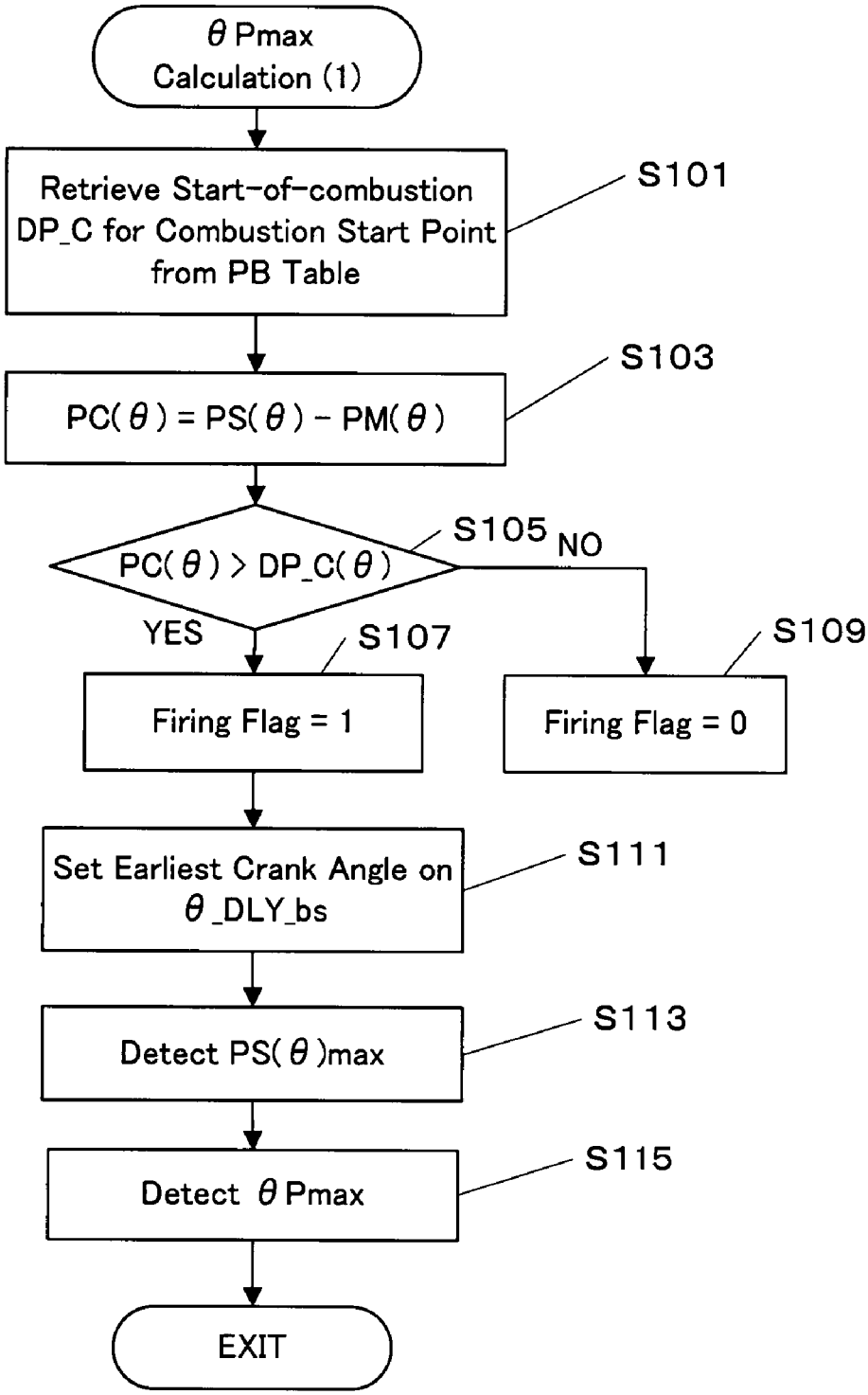
FIG. 4 is a flowchart of a process for calculating a crank angle in accordance with a first embodiment of the present invention.

Referring to FIG. 4, start of combustion detecting unit 43 refers to a table with the intake air pressure PB as a searching parameter to retrieve a determination value DP_C for determining combustion starting point(S101). When the combustion pressure PC(θ) that is calculated as described above (S103) exceeds the determination value (S105), a firing flag is set to a value of 1 (S107). The calculated combustion pressure PC(θ) vibrates around the combustion start point of the air-fuel mixture. In this case, the crank angle when the PC(θ) first exceeds the determination value is used as a firing time point. This angle is represented by θ_DLY_bs (S111).

When a θPmax detecting unit 45 detects the firing time point θ_DLY_bs, the unit 45 detects a maximum sensor output PS(θ), a maximum output after the firing time point θ_DLY_bs, which is represented by PS(θ)max (S113), and the crank angle at that moment is detected and is represented by crank angle θPmax, corresponding to the maximum cylinder pressure (S115).

Referring to FIG. 2, during the normal operation, the peak time point that has passed the top dead center is detected as the maximum internal cylinder pressure PS(θ)max and the crank angle at that moment is detected as the crank angle θPmax corresponding to the maximum cylinder pressure.

Figure 5:
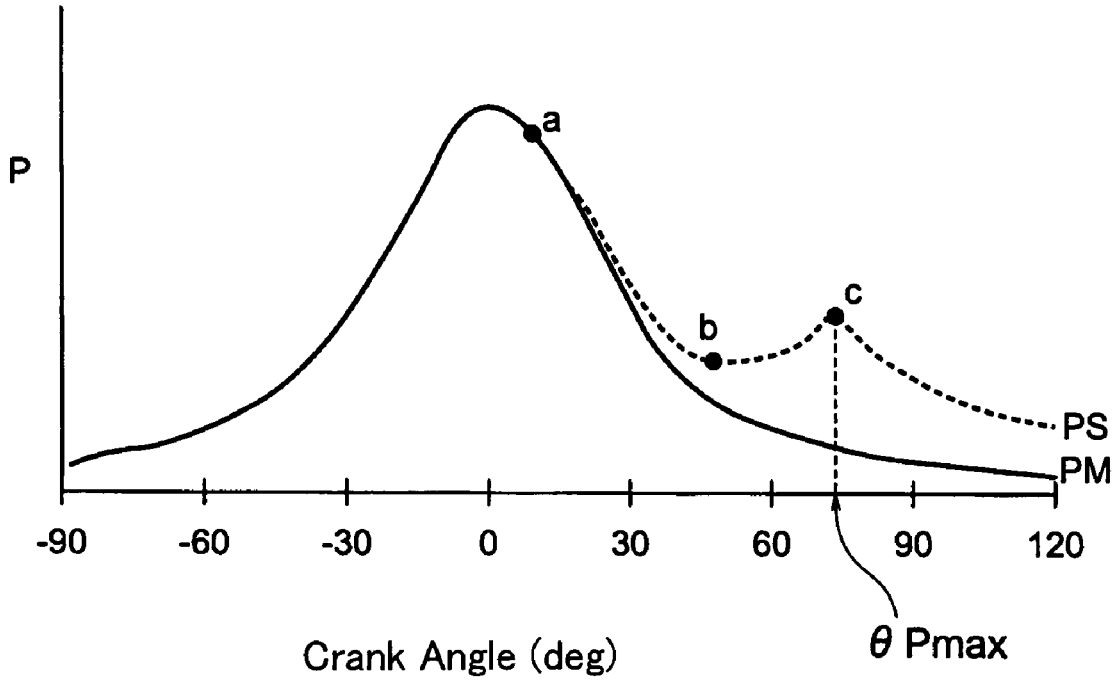
FIG. 5 is a graph showing a relation between a pressure and a crank angle during an ignition timing retard operation in accordance with a first embodiment of the present invention.

FIG. 5 illustrates a relation between the pressure and the crank angle during a ignition timing retard operation for rapid warming-up of the catalyst. In FIG. 5, Curve PM and Curve PS represent a motoring pressure and a sensor output respectively. Also, "a" indicates an ignition time point, "b" indicates a firing moment and "c" indicates a time point when the internal cylinder pressure becomes a maximum.

In general, during the ignition timing retard operation for rapid warming-up, the ignition timing a is controlled to be after the top dead center of the crank angle 0 degree as shown in FIG. 5. Then, the combustion start detecting unit 43 detects firing at the firing time b. The θPmax detecting unit 45 detects a maximum sensor output PS at a time point c after the firing time b when the internal cylinder pressure becomes a maximum, and the crank angle at time c is detected as θPmax.

Figure 6:
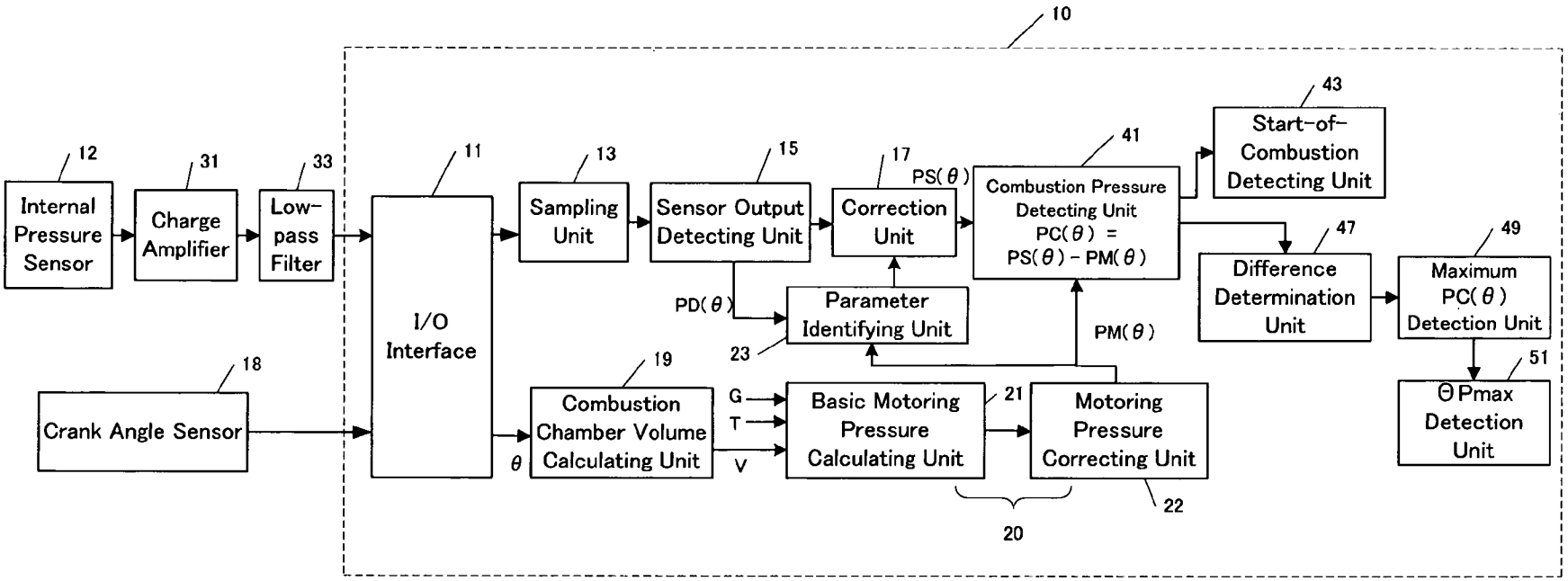
FIG. 6 illustrates functional blocks of an alternative embodiment of the present invention.
Figure 7:
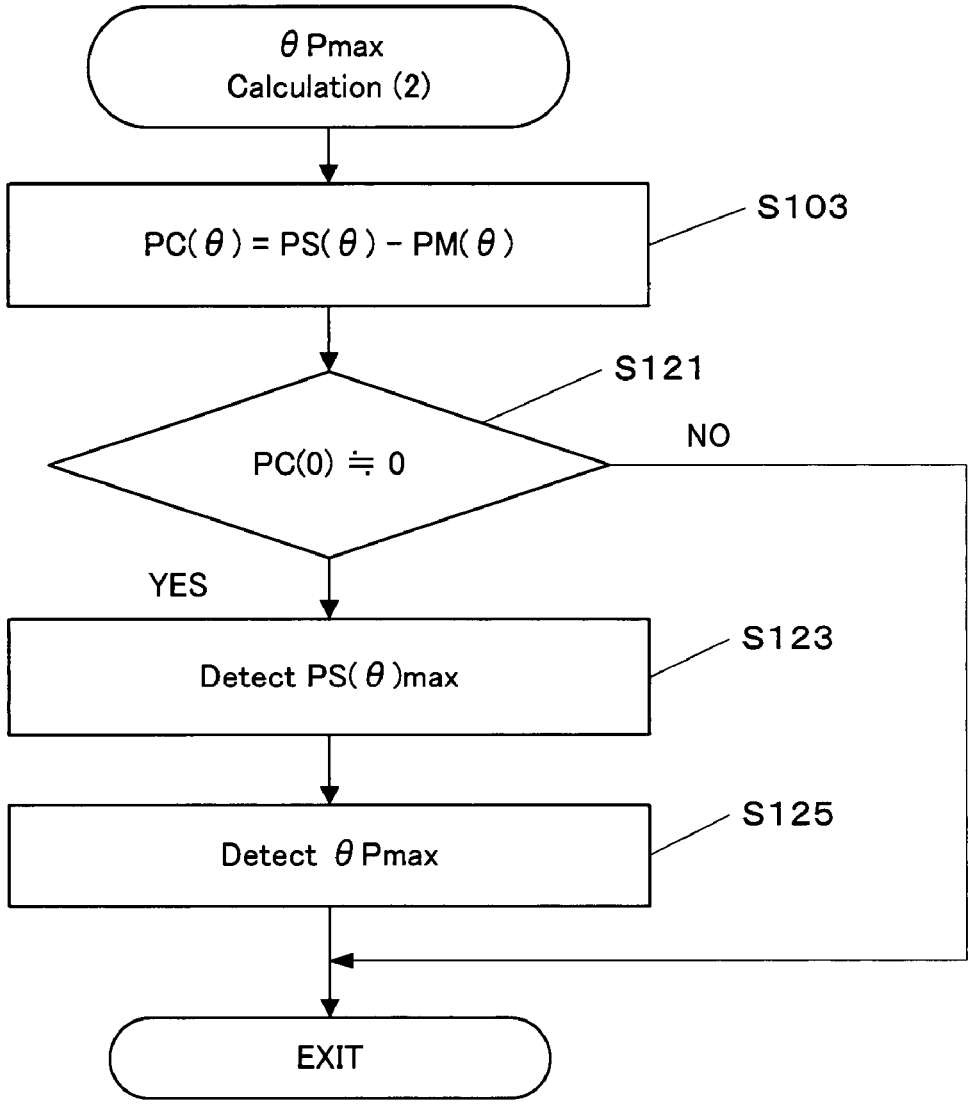
FIG. 7 is a flowchart of a process for calculating a crank angle in accordance with an alternative embodiment of the present invention.

Alternatively, the θPmax can be detected according to another embodiment as described below. FIG. 6 illustrates functional blocks of another embodiment of the present invention. The same reference numbers as in FIG. 2 are used to indicate the same components. FIG. 7 is a flowchart showing another embodiment of the present invention.

In FIG. 6 and FIG. 7, a difference determining unit 47 determines whether or not the combustion pressure PC(θ) calculated by the combustion pressure detecting unit 41 is equal to or smaller than a predetermined value at the top dead center and thereby determines whether or not the maximum pressure in the cylinder and the pressure at the top dead center are equal(S121). When the PC(θ) is larger than the predetermined value, the θPmax calculation process is terminated.

When the difference determining unit 47 determines that the combustion pressure PC(θ) is equal to or smaller than the predetermined value (for example, zero), a maximum PC(θ)

detecting unit 49 determines that the engine is in an ignition timing retard operation and then detects a time point when the PC (θ) becomes a maximum value thereafter.

A θPmax detecting unit 51 detects a time point when the PC(θ) becomes a maximum value in the maximum PC(θ) detecting unit 49 and detects a crank angle θPmax at such detected time point.

Figure 8:
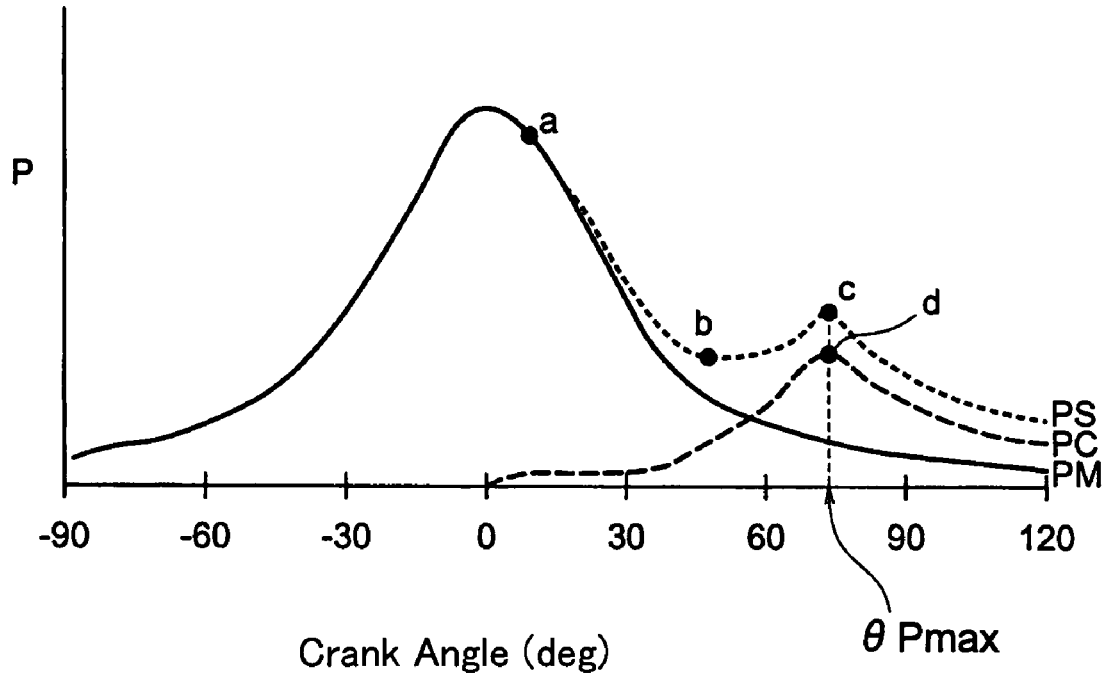
FIG. 8 is a graph showing a relation between a pressure and a crank angle during an ignition timing retard operation in accordance with an alternative embodiment of the present invention.

FIG. 8 illustrates a relation between the pressure and the crank angle during the ignition timing retard operation for rapid warming-up. In FIG. 8, Curve PM, Curve PS and Curve PC represent a motoring pressure, a sensor output and a combustion pressure respectively. Also, "d" indicates a time point when the combustion pressure becomes a maximum.

In general, during the ignition timing retard operation for rapid warming-up, the combustion pressure is zero at the top dead center because the ignition timing is set to be after the top dead center as shown in FIG. 8. When it is determined by the difference detecting unit 47 that the combustion pressure PC at the top dead center is zero, the maximum PC(θ) detecting unit 49 detects a time point d when the combustion pressure PC becomes a maximum. At the time point when the combustion pressure PC becomes a maximum, the sensor pressure PS becomes a maximum as well. The θPmax detecting unit 51 detects a crank angle θPmax corresponding to the time point d when the detected combustion pressure PC becomes the maximum.

Although the present invention has been described above with reference to specific embodiments, the present invention is not limited to such specific embodiments. Besides, the present invention is applicable to any of a gasoline engine and a diesel engine.

What is claimed is:

1. A control unit for controlling an internal-combustion engine, the apparatus comprising:

pressure detecting means, provided in a combustion chamber of the engine, for detecting pressure;

estimating means for estimating a motoring pressure of the engine;

means for detecting a combustion starting time when a difference between an internal pressure determined based on an output of the pressure detecting means and the pressure estimated by the estimation means exceeds a predetermined value, wherein, when the pressure detected based on the output of the pressure detecting means reaches a maximum after the combustion starting time has been detected, the crank angle at this time point is determined to correspond to the maximum internal pressure that is generated by combustion;

means for calculating a capacity of the combustion chamber of the engine;

means for determining intake air volume; and means for determining a temperature of the intake air, wherein the estimating means estimates a motoring pressure based on a state equation using the capacity of the combustion chamber, the intake air volume and the temperature of the intake air.

2. The control unit of claim 1, wherein, in a compression stroke of a cylinder, the crank angle corresponding to the maximum internal pressure is detected with the detected pressure corrected such that the difference between the motoring pressure and the detected pressure is minimal.

3. A control unit for controlling an internal-combustion engine, the apparatus comprising:

pressure detecting means provided in a combustion chamber of the engine;

estimation means for estimating a motoring pressure of the engine;

means for calculating a difference between an internal cylinder pressure determined based on an output of the pressure detecting means at the top dead center of a cylinder of the engine and the pressure estimated by the estimation means, wherein, if the difference is smaller than a predetermined value, when a difference between the detected pressure and the estimated pressure reaches a maximum, the crank angle at this time point is determined to correspond to the maximum internal pressure produced by combustion;

means for calculating a capacity of the combustion chamber of the engine;

means for determining intake air volume; and means for determining a temperature of the intake air, wherein the estimating means estimates a motoring pressure based on a state equation using the capacity of the combustion chamber, the intake air volume and the temperature of the intake air.

4. The control unit of claim 3, wherein, in a compression stroke of a cylinder, the crank angle corresponding to the maximum internal pressure is detected with the detected pressure corrected such that the difference between the motoring pressure and the detected pressure is minimal.

5. A method of controlling an internal-combustion engine having a pressure sensor provided in a combustion chamber of the engine, comprising:

detecting an internal pressure in the combustion chamber of the engine based on outputs of the pressure sensor;

estimating a motoring pressure of the engine;

detecting a combustion starting time when a difference between the internal pressure detected based on the output of the pressure sensor and the estimated pressure exceeds a predetermined value;

when the pressure detected based on the output of the pressure sensor reaches a maximum after the combustion starting time has been detected, determining the crank angle at this time point to correspond to the maximum internal pressure that is generated by combustion;

calculating a capacity of the combustion chamber of the engine;

determining intake air volume;

determining a temperature of the intake air; and estimating the motoring pressure based on a state equation using the capacity of the combustion chamber, the intake air volume and the temperature of the intake air.

6. The method of claim 5, wherein, in a compression stroke of a cylinder, the crank angle corresponding to the maximum internal pressure is detected with the detected pressure corrected such that the difference between the motoring pressure and the detected pressure is minimal.

7. A method for controlling an internal-combustion engine having a pressure sensor provided in a combustion chamber of the engine, comprising:

estimating a motoring pressure of the engine;

calculating a difference between an internal cylinder pressure determined based on an output of the pressure sensor at the top dead center of a cylinder of the engine and the motor pressure estimated by the estimation means; and if the difference is smaller than a predetermined value, determining the crank angle corresponding to the maximum internal pressure produced by combustion when a difference between the detected pressure and the estimated motor pressure reaches a maximum;

calculating a capacity of the combustion chamber of the engine;

determining intake air volume;

determining a temperature of the intake air; and determining the motoring pressure based on a state equation using the capacity of the combustion chamber, the intake air volume and the temperature of the intake air.

8. The method of claim 7, further comprising, in a compression stroke of a cylinder, detecting the crank angle corresponding to the maximum internal pressure with the detected pressure corrected such that the difference between the motoring pressure and the detected pressure is minimal.

* * * * *